US009163428B1

(12) United States Patent
Fare

(10) Patent No.: US 9,163,428 B1
(45) Date of Patent: Oct. 20, 2015

(54) DOOR LOCK ILLUMINATION APPARATUS

(71) Applicant: Michael S. Fare, Ellington, MO (US)

(72) Inventor: Michael S. Fare, Ellington, MO (US)

( * ) Notice: Subject to any disclaimer, the term of this patent is extended or adjusted under 35 U.S.C. 154(b) by 189 days.

(21) Appl. No.: 14/036,877

(22) Filed: Sep. 25, 2013

(51) Int. Cl.
*E05B 17/10* (2006.01)

(52) U.S. Cl.
CPC ..... *E05B 17/10* (2013.01)

(58) Field of Classification Search
CPC ..... F21S 9/022; F21W 2121/004; F21Y 2101/02; G01S 13/56; H05B 31/00; H05B 33/0842; H05B 33/0845; H05B 33/0833; H05B 33/0857; H05B 33/0896; H05B 33/0803; H05B 37/02; H05B 37/0245; H05B 37/0272
USPC ..... 362/94, 100, 137, 145, 501, 802; 200/42.01, 43.09, 61.81, 61.62, 61.82
See application file for complete search history.

(56) References Cited

U.S. PATENT DOCUMENTS

| | | | | |
|---|---|---|---|---|
| 2,734,123 | A | 2/1956 | Gerber | |
| 2,813,195 | A | 11/1957 | Willey et al. | |
| 3,971,028 | A * | 7/1976 | Funk | 307/157 |
| D251,804 | S | 5/1979 | Balkany et al. | |
| 4,779,171 | A | 10/1988 | Ferguson | |
| 4,872,095 | A * | 10/1989 | Dubak et al. | 362/100 |
| 5,499,171 | A * | 3/1996 | Simpson et al. | 362/100 |
| 6,058,635 | A | 5/2000 | Morris | |
| 6,454,324 | B1 * | 9/2002 | Lewis et al. | 292/341.16 |
| 6,729,740 | B1 * | 5/2004 | Gazard | 362/100 |
| 7,656,308 | B2 * | 2/2010 | Atkins | 340/12.3 |
| 8,021,012 | B2 * | 9/2011 | Dunbar | 362/100 |
| 8,911,119 | B1 * | 12/2014 | Colby | 362/311.02 |

* cited by examiner

*Primary Examiner* — Hargobind S Sawhney
(74) *Attorney, Agent, or Firm* — Grace J. Fishel

(57) ABSTRACT

A door illumination apparatus directs light emitted by a string of diodes towards a face of an exterior door to enhance visual identification of a door lock. The apparatus positions on a periphery of a door jamb, such as in a recess in a jamb stop. The illumination apparatus actuates on demand from a user, lighting the door face through three-way switches that are operable from a position in proximity to the door, at least one of which three-way switches being a compatible electronic three-way switch which is operable remotely from a device configured to be carrier by a user.

14 Claims, 4 Drawing Sheets

DOOR LOCK ILLUMINATION APPARATUS

BACKGROUND OF THE INVENTION

1. Field of the Invention

The present invention relates to an illumination apparatus for the face of an exterior door. More particularly, the illuminating apparatus projects light onto the face of the door for enhanced visual identification of a door lock.

2. Brief Description of the Prior Art

The following background information may present examples of specific aspects of the prior art (e.g., without limitation, approaches, facts or common wisdom) that, while expected to be helpful to further educate the reader is not to be construed as limiting the present invention, or any embodiments thereof, to anything stated or implied therein.

In the dark, such as during the night or during a storm, the exterior of a door may not be clearly visible and a user may find it problematic to locate the door lock. While many homes have outside lights, they must be turned on when leaving the premises and must remain on until a person returns and turns the light off. This wastes energy if the user leaves during the day. In addition, exterior lights burning during the day may draw attention that the premises are unoccupied, thereby causing a security issue.

Light-emitting diodes (LEDs) are used as indicator lights in many devices and increasingly used for other lighting. LEDs have long service life, extreme vibration resistance and permit considerably shallower mountings compared to most bulb-type assemblies.

Even though porch lights address some of the needs of the market, there is need for an illumination apparatus that projects light on a door lock when needed under control of a user from the outside of the door.

BRIEF SUMMARY OF THE INVENTION

In one embodiment of the present invention, an illumination apparatus directs light, on demand, from a string of light emitting diodes on the face of an exterior door to enhance visual identification of the door lock. In this manner, the illumination apparatus does not project light until needed.

In a first broad aspect of the invention, an illumination apparatus for projecting a light towards a face of an exterior door with a door lock, the door hinged within a door jamb with a jamb stop against which the door closes, the illumination apparatus comprising:

a string of light emitting diodes, the string of light emitting diodes being disposed along the door jamb, the door jamb being configured to form a periphery around the door, the string of light emitting diodes being operable to emit the light; and at least one three-way switch coupled to at least one compatible electronic three-way switch, said three-way switch and said compatible electronic three-way switch interconnected with each other for controlling the illumination apparatus from more than one location.

In a second broad aspect of the invention, the light emitting diodes are multi-color diodes and the illumination apparatus further comprises a processor being operable to control a color section for each of the light emitting multi-color diodes.

Other aspects include a radio frequency receiver in the compatible electronic three-way switch operationally under control of a radio frequency transmitter positioned outside of the door with the radio frequency transmitter being configured to be carried by a user and the illumination apparatus is recessed in the jamb stop along an upper horizontal section of the door jamb.

In yet other aspects, when the diodes are multi-color diodes including a red diode, a green diode and a blue diode, the processor is further operable to control the duration each diode component of the multi-color diode emits light.

One objective of the present invention is that unlocking a door lock in the dark is facilitated. Another objective is to minimize power consumption. These and other advantages of the invention will be further understood and appreciated by those skilled in the art by reference to the following written specification, claims and appended drawings.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
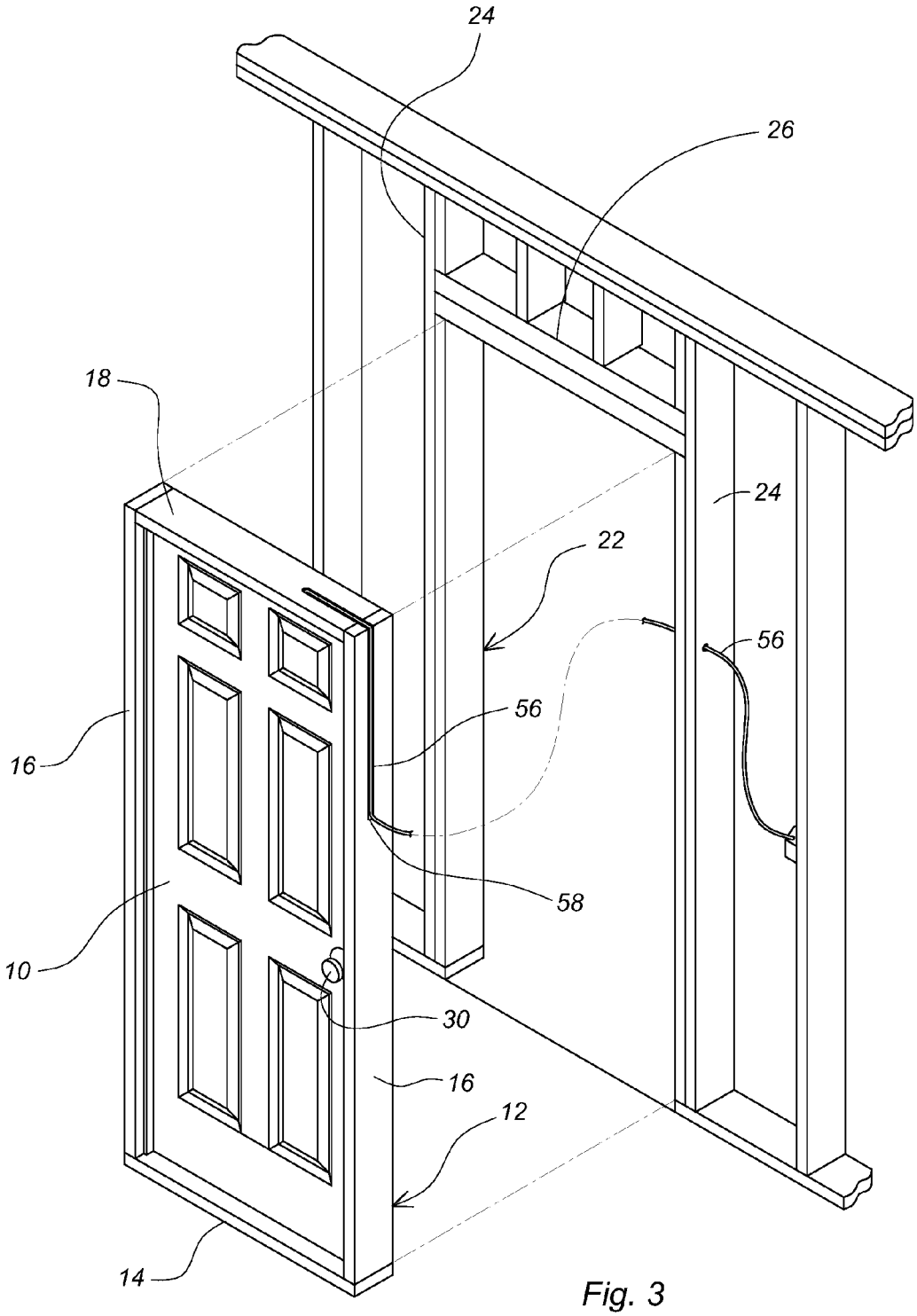
FIG. 3 is a detailed perspective view of a prehung door with electrical wiring passing thought a channel in a door jamb within which the door is hinged; said prehung door exploded from a door frame within which it is mounted.

As shown in FIG. 3, an exterior door 10 is hinged in a door jamb 12 including a sill 14, vertical jambs 16 and a horizontal jamb 18. A jamb stop 20 is provided along vertical jambs 16 and horizontal jamb 18 against which door 10 is closed. Doors 10 are commonly sold prehung in door jamb 12 and installed in a door frame 22 typically encircled by king studs 24 and a lintel 26.

Figure 1:
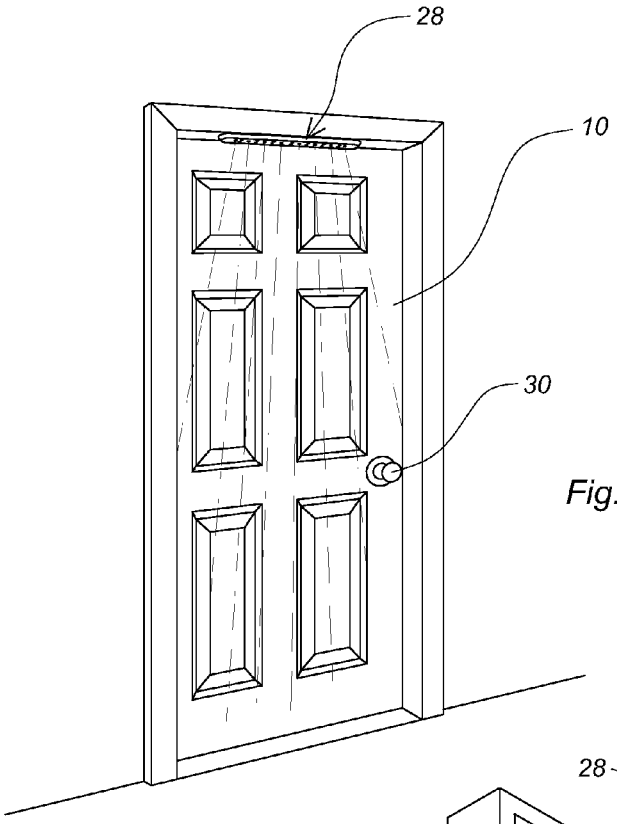
FIG. 1 is a perspective view of an illumination apparatus projecting a light on a door lock in accordance with an embodiment of the present invention.
Figure 2:
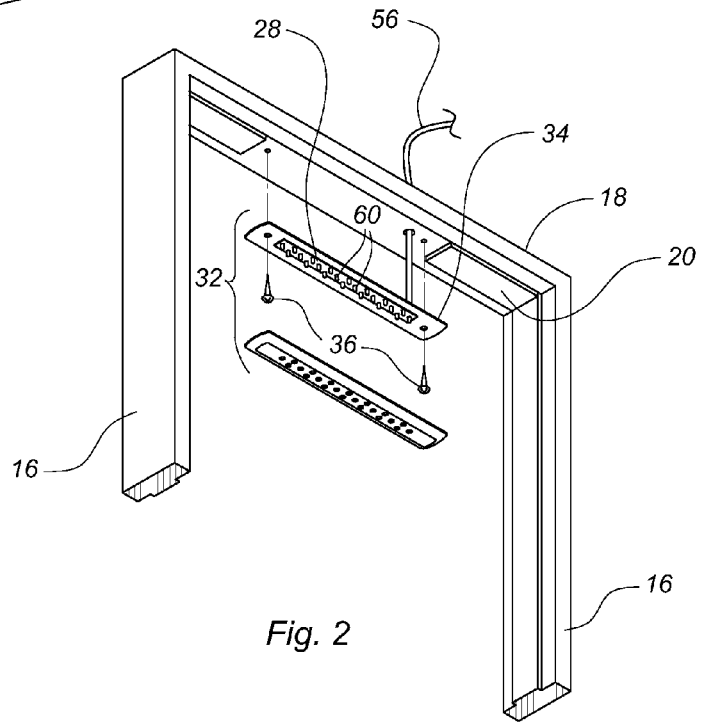
FIG. 2 is an exploded view of the illumination apparatus including a string of light of emitting diodes in a light bar recessed in a jamb stop.

Turning to FIGS. 1 and 2, a string of light emitting diodes 28 is disposed around door jamb 12 and, in specific, recessed in jamb stop 20 along horizontal jamb 18. In this position, string of light emitting diodes 28 emit light which shines down on the exterior face of door 10 thus illuminating a door lock 30. String of light emitting diodes 28 as shown in FIG. 2 comprise a light bar 32 with a metal heat sink 34 that may be efficacious for dissipating the heat generated by the diodes. Light bar 32 is attached to door jamb 12 with screws 36 or other suitable fasteners with metal heat sink 34 against door jamb 12. While light bar 32 is shown in the drawings, string of light emitting diodes 28 may be LED strip lights, also known as LED ribbon lights or LED tape lights.

Figure 5:
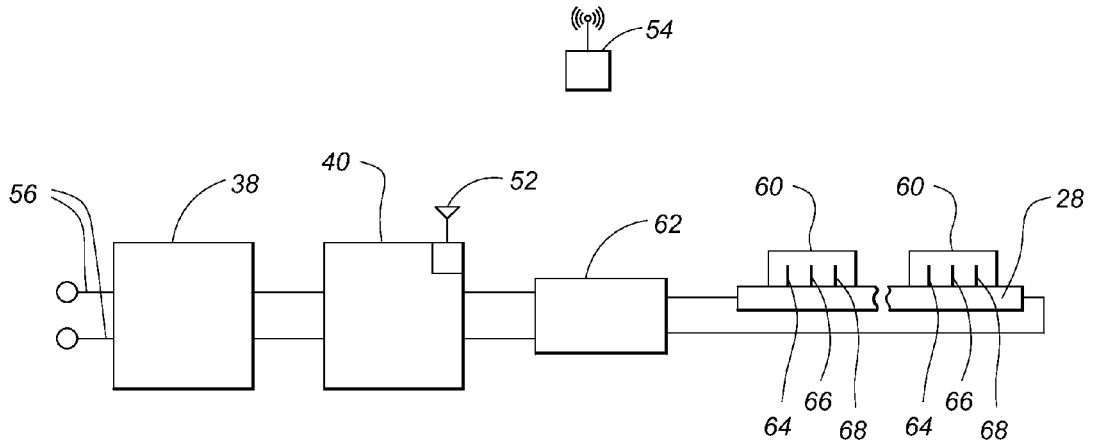
FIG. 5 is a diagram showing a three-way switch connected to a compatible electronic switch through which power is passed to a string of multi-color light emitting diodes under control of a processor; and, FIG. 6 is a circuit diagram of a representative three-way switch coupled with a compatible electronic three-way switch.
Figure 6:
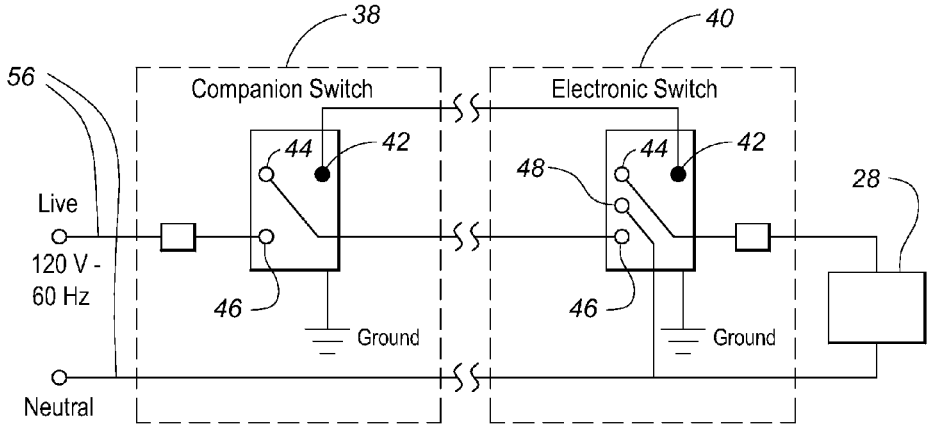

At least one three-way switch 38 as shown in FIGS. 5 and 6 and at least one compatible electronic three-way switch 40 are interconnected with each other for controlling the flow of power to string of light emitting diodes 28. Such paired three-way switches are commercially available, such as, without limitation, a Leviton 6696-W wireless 3-way switch kit, a circuit diagram for which is shown in FIG. 6. As shown in FIG. 6, three-way switch 38 includes first, second and third terminals (42, 44 and 46, respectively) and compatible electronic three-way switch 40 includes an addition terminal 48. Connections between the terminals in three-way switch 38 are made or broken by manually moving a lever 50, preferable positioned on a wall on the inside of door 10 adjacent door frame 22. Connections between the terminals in compatible electronic three-way switch 40 are under control of a radio frequency receiver 52 in response to signals received from a radio frequency transmitter 54 which may be configured to be carried by a user.

Figure 4:
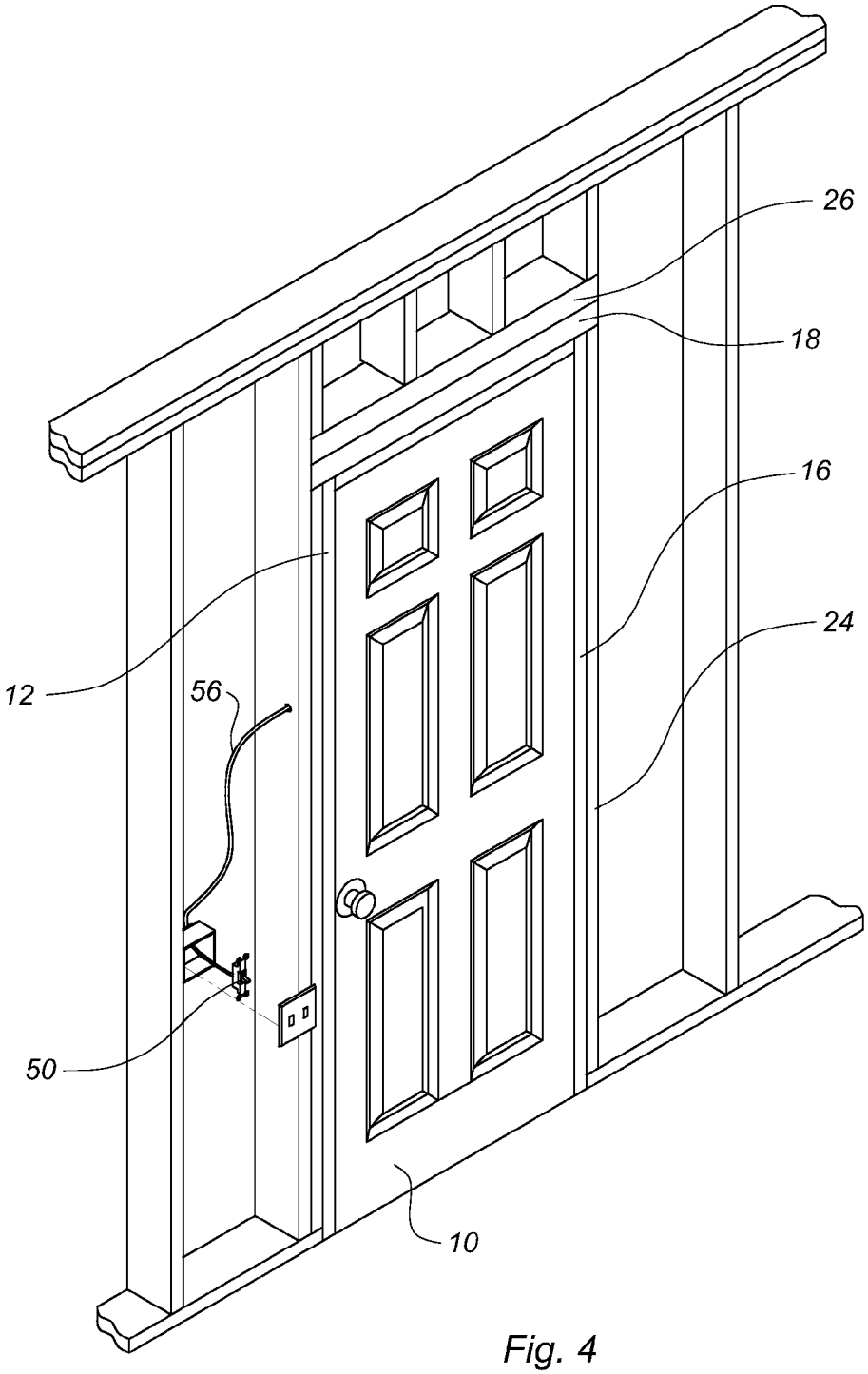
FIG. 4 is a detailed perspective view of the electrical wiring passing through the frame within which the door jamb is mounted to a three-way switch on the inside of the door.

String of light emitting diodes 28 are connected to three-way switch 38 and compatible electronic three-way switch 40 with wiring 56 preferably received in a channel 58 provided on the outside of horizontal jamb 18 and one of vertical jambs 16 as seen in FIG. 3. Wiring 56 is routed through door frame 22 and is connected to switches 38, 40 on the inside of the door adjacent door frame 22 as shown in FIG. 4.

Diodes 60 in string of light emitting diodes 28 may be colored diodes. When the diodes are multi-color diodes as shown in FIG. 5, a processor 62 operably controls a color selection for each light emitting multi-color diode 60. Processor 62 may be one or more apparatus and/or one or more systems that are capable of accepting a structured input, processing the structured input according to prescribed rules, and producing results of the processing as output. Examples of a processor may include: a computer; a stationary and/or portable computer; a computer having a single processor, multiple processors, or multi-core processors, which may operate in parallel and/or not in parallel; a general purpose computer; a supercomputer; a mainframe; a super mini-computer; a mini-computer; a workstation; a micro-computer; a server; a client; an interactive television; a web appliance; a telecommunications device with internet access; a hybrid combination of a computer and an interactive television; a portable computer; a tablet personal computer (PC); a personal digital assistant (PDDA); a portable telephone; application-specific hardware to emulate a computer and/or software, such as, for example, a digital signal processor (DSP), a field-programmable gate array (FPGA), an application specific integrated circuit (ASIC), an application specific instruction-set processor (ASIP), a chip, chips, a system on a chip, or a chip set; a data acquisition device; an optical computer; a quantum computer; a biological computer; and generally, an apparatus that may accept data, process data according to one or more stored software programs, generate results, and typically include input, output, storage, arithmetic, logic, and control units. In some embodiments, processor 62 may be integrated with compatible electronic three-way switch 40.

Multi-color diodes 60 may include a plurality of colored diodes packaged together, such as a red diode 64, green diode 66 and a blue diode 68. Processor 62 is programmable to turn each of the colors on or off, so if the red diode 64 is turned on, then the color emitted by string of light emitting diodes 28 is red. When the blue diode 68 is turned on it is blue, if both the blue and red diodes are turned on then the color is a shade of purple. Similarly combining the red diode 64 with the green diode 66 gives yellow and the blue diode 68 and green diode 66 gives cyan.

Processor 62 may be programmed to give other effects. For example although the color changing LEDs 60 may produce the six colors mentioned above, if the red diode 64 is combined with the blue diode 68 but the blue diode is only driven at 50% of its normal brightness then a color half way between red and magenta is generated. Other effects may be provided by controlling the duration each multi-color diode 60 emits light. For example, if the LEDs are turned on and off very quickly, to the human eye the lights look like they are constantly on. If the amount of time processor 62 turns them on is the same as the time they are off, the LEDs will have 50% of their full brightness. When done with the red diode 64, green diode 66 and blue diode 68, any desired color may be achieved to effect an emitted light with a desired color, e.g., red for Christmas, green for St. Patrick, purple for lent, etc.

String of light emitting diodes 28 and three-way switch 38 and compatible electronic switch 40 may be sold a kit for installation on an existing door 10. With new construction, light emitting diodes 28 may be installed on a prehung door and three-way switches 38, 40 wired on site.

In use, string of light emitting diodes 28 need not be activated until needed by a user carrying a radio frequency transmitter 54. Upon receipt of a signal, radio frequency receiver 52 in compatible electronic three-way switch 40 causes string of light emitting diodes to project light towards door lock 30. Upon entering the premises, the user may turn off the lights from the inside with three-way switch 38 thus saving energy and avoiding signaling that the premises are unoccupied by having lights constantly on.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. An illumination apparatus for projecting a light towards a door at least partially hinged within a door jamb, said door being an exterior door with a door lock and having a jamb stop against which the door closes, the illumination apparatus comprising:

a string of light emitting diodes, the string of light emitting diodes being disposed along the door jamb, the door jamb being configured to form a periphery around the door, the string of light emitting diodes being operable to emit the light; and at least one three-way switch coupled to at least one compatible electronic three-way switch, said three-way switch and said compatible electronic three-way switch interconnected with each other for controlling the illumination apparatus from more than one location.

2. The apparatus of claim 1 wherein the compatible electronic three-way switch includes a radio frequency receiver operationally under control of a radio frequency transmitter positioned outside of the door, said radio frequency transmitter being configured to be carried by a user.

3. The apparatus of claim 2 wherein the illumination apparatus is operable to project the light towards the door lock, said lock on an exterior side of the door.

4. The apparatus of claim 3 wherein the illumination apparatus is recessed in the jamb stop along an upper horizontal section of the door jamb.

5. An illumination apparatus for projecting a light towards a door at least partially hinged within a door jamb, said door being an exterior door with a door lock and having a jamb stop against which the door closes, the illumination apparatus comprising:

a string of light emitting diodes, the string of light emitting diodes being disposed along the door jamb, the door jamb being configured to form a periphery around the door, the string of light emitting diodes being operable to emit the light, said light emitting diodes being multi-color diodes;

at least one three-way switch coupled to at least one compatible electronic three-way switch, said three-way switch and said compatible electronic three-way switch interconnected with each other for controlling the illumination apparatus from more than one location; and, a processor being operable to control a color section for each light emitting multi-color diode.

6. The apparatus of claim 5 wherein the processor is additionally operable to control the duration each light emitting multi-color diode emits light.

7. The apparatus of claim 5 wherein each multi-color light emitting diode includes a red diode, a green diode and a blue diode under control of the processor.

8. The apparatus of claim 7 wherein the processor is additionally operable to control the duration the red diode, the green diode and the blue diode emits light.

9. An illumination apparatus for projecting a light towards a door at least partially hinged within a door jamb, said door being an exterior door with a door lock and having a jamb stop against which the door closes, the illumination apparatus comprising:

a string of light emitting diodes, the string of light emitting diodes being disposed along the door jamb, the door jamb being configured to form a periphery around the door, the string of light emitting diodes being operable to emit the light;

a three-way switch coupled to a compatible electronic three-way switch, said three-way switch and said compatible electronic three-way switch interconnected with each other for controlling the illumination apparatus from more than one location;

said compatible electronic three-way switch having a radio frequency receiver operationally under control of a radio frequency transmitter positioned outside of the door, said radio frequency transmitter being configured to be carried by a user; and, said three-way switch located on an interior side of the exterior door adjacent a door frame within which the door jamb is mounted.

10. The apparatus of claim 9 wherein the illumination apparatus is recessed in the jamb stop along an upper horizontal section of the door jamb.

11. The apparatus of claim 9 wherein said light emitting diodes are multi-color diodes being operably connected to a processor that controls a color section for each light emitting multi-color diode.

12. The apparatus of claim 11 wherein the processor is additionally operable to control the duration each light emitting multi-color diode emits light.

13. The apparatus of claim 11 wherein each multi-color light emitting diode includes a red diode, a green diode and a blue diode under control of the processor.

14. The apparatus of claim 13 wherein the processor is additionally operable to control the duration the red diode, the green diode and the blue diode emits light.

* * * * *